US007569985B2

(12) United States Patent
Yoo et al.

(10) Patent No.: US 7,569,985 B2
(45) Date of Patent: Aug. 4, 2009

(54) ELECTRON EMISSION DISPLAY

(75) Inventors: Seung-Joon Yoo, Yongin-si (KR); Cheol-Hyeon Chang, Yongin-si (KR); Su-Kyung Lee, Yongin-si (KR); Won-Il Lee, Yongin-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 363 days.

(21) Appl. No.: 11/588,361

(22) Filed: Oct. 27, 2006

(65) Prior Publication Data

US 2007/0096628 A1 May 3, 2007

(30) Foreign Application Priority Data

Oct. 31, 2005 (KR) ..... 10-2005-0103524

(51) Int. Cl.
*H01J 63/04* (2006.01)

(52) U.S. Cl. ..... 313/496

(58) Field of Classification Search ..... 313/495–497, 313/309–310

See application file for complete search history.

(56) References Cited

U.S. PATENT DOCUMENTS 5,760,538 A * 6/1998 Mitsutake et al. ..... 313/422
5,955,850 A * 9/1999 Yamaguchi et al. ..... 313/495
6,137,213 A * 10/2000 Moyer et al. ..... 313/309
2004/0227453 A1 * 11/2004 Ando et al. ..... 313/495

* cited by examiner

*Primary Examiner*—Toan Ton
*Assistant Examiner*—Hana A Sanei
(74) *Attorney, Agent, or Firm*—Stein McEwen, LLP

(57) ABSTRACT

An electron emission display includes first and second substrates facing each other, a plurality of driving electrodes formed on the first substrate, a plurality of electron emission regions controlled by the driving electrodes, a focusing electrode disposed on and insulated from the driving electrodes and provided with openings through which electron beams pass, a plurality of phosphor layers formed on a surface of the second substrate, an anode electrode formed on surfaces of the phosphor layers, and a plurality of spacers for maintaining a gap between the first and second substrates. Among the electron emission regions disposed in the opening adjacent to the spacer, one electron emission region, which is closest to the adjacent spacer, is spaced apart from an inner wall of the opening by a first distance that is different from a second distance from another electron emission region, which is farthest from the adjacent spacer, to the inner wall of the opening.

20 Claims, 5 Drawing Sheets

ELECTRON EMISSION DISPLAY

CROSS-REFERENCE TO RELATED APPLICATIONS

This application claims priority to and the benefit of Korean Patent Application No. 2005-103524 filed in the Korean Intellectual Property Office on Oct. 31, 2005, the entire contents of which are incorporated herein by reference.

BACKGROUND OF THE INVENTION

1. Field of the Invention

Aspects of the present invention relate to an electron emission display, and more particularly, to an electron emission display that can effectively focus electron beams emitted from electron emission regions by improving a focusing electrode.

2. Description of the Related Art

Generally, electron emission elements are classified into those using hot cathodes as an electron emission source, and those using cold cathodes as the electron emission source. There are several types of cold cathode electron emission elements, including Field Emitter Array (FEA) elements, Surface Conduction Emitter (SCE) elements, Metal-Insulator-Metal (MIM) elements, and Metal-Insulator-Semiconductor (MIS) elements.

The FEA element includes electron emission regions and cathode and gate electrodes that are driving electrodes. The electron emission regions are formed of a material having a relatively low work function or a relatively large aspect ratio, such as a molybdenum-based material, a silicon-based material, and a carbon-based material such as carbon nanotubes, graphite, and diamond-like carbon so that electrons can be effectively emitted when an electric field is applied thereto under a vacuum atmosphere. When the electron emission regions are formed of the molybdenum-base material or the silicon-based material, they are formed in a pointed tip structure.

Generally, the electron emission elements are arrayed on a first substrate to form an electron emission device. The electron emission device is combined with a second substrate, on which a light emission unit having phosphor layers and an anode electrode are formed, to establish an electron emission display.

That is, the conventional electron emission device includes electron emission regions and a plurality of driving electrodes functioning as scan and data electrodes. By the operation of the electron emission regions and the driving electrodes, the on/off operation of each pixel and an amount of electron emission are controlled. The electron emission display excites phosphor layers using the electrons emitted from the electron emission regions to display a predetermined image.

The first and second substrates are sealed together at their peripheries using a sealing member and the inner space between the first and second substrates is evacuated to form a vacuum envelope. In addition, a plurality of spacers is disposed in the vacuum envelope to prevent the substrates from being damaged or broken by a pressure difference between the inside and outside of the vacuum envelope.

The spacers are exposed to the internal space of the vacuum envelope in which electrons emitted from the electron emission regions move. Therefore, the spacers are charged with positive or negative electric charges by the electrons colliding therewith. The charged spacers may change the electron beam path by attracting or repulsing the electrons. As a result, a non-emission region of the phosphor layer increases.

For example, when the spacers are charged as the positive electric charge, the spacers attract the electrons such that a relatively large amount of electrons collides with a portion of the phosphor layer near the spacers. As a result, the luminance of the portion around the spacers is higher than those of other portions. In this case, the spacers may be detected on a screen. In order to prevent the change of the electron beam path, the spacers may be coated with an insulation material or may be connected to the electrodes.

SUMMARY OF THE INVENTION

Aspects of the present invention provide an electron emission display that can improve the directionality of electron beams by adjusting a distance between an electron emission region and a focusing electrode according to a degree of change of an electron beam path caused by spacers.

According to an embodiment of the present invention, there is provided an electron emission display including: first and second substrates facing each other; a plurality of driving electrodes formed on the first substrate; a plurality of electron emission regions controlled by the driving electrodes; a focusing electrode disposed on and insulated from the driving electrodes and provided with openings through which electron beams pass; a plurality of phosphor layers formed on a surface of the second substrate; an anode electrode formed on surfaces of the phosphor layers; and a plurality of spacers for maintaining a gap between the first and second substrates, wherein, among the electron emission regions disposed in the opening adjacent to the spacer, one electron emission region, which is closest to the adjacent spacer, is spaced apart from an inner wall of the opening by a first distance that is different from a second distance from another electron emission region, which is farthest from the adjacent spacer, to the inner wall of the opening.

While not required in all aspects, the first distance may be less than the second distance. Alternatively, the first distance is greater than the second distance. While not required in all aspects, distances between the electron emission regions may be identical to each other. A gap between the openings adjacent to the spacer disposed between the openings may be greater than that between the openings between which the spacer is not disposed. Alternatively, a gap between the openings adjacent to the spacer disposed between the openings may be less than that between the openings between which the spacer is not disposed.

While not required in all aspects, each of the spacers may be formed in a wall-shape or a cylindrical shape. The driving electrodes may include cathode electrodes and gate electrodes crossing the cathode electrodes with an insulation layer interposed between the cathode and gate electrodes. While not required in all aspects, the openings of the focusing electrodes are formed by one per each crossed region of the cathode and gate electrodes. The electron emission regions may be formed of a material selected from the group consisting of carbon nanotubes, graphite, graphite nanofibers, diamonds, diamond-like carbon, C60, silicon nanowires, and a combination thereof.

According to another embodiment of the present invention, there is provided an electron emission display including: first and second substrates facing each other; cathode and gate electrodes formed on the first substrate and crossing each other with an insulation layer interposed between the cathode and gate electrodes; a plurality of electron emission regions connected to the cathode electrode; a focusing electrode disposed on and insulated from the cathode and gate electrodes and provided with openings through which electron beams pass; a phosphor layer formed on the second substrate; an anode electrode formed on the second substrate and electrically connected to the phosphor layers; and a spacer disposed between the first and second substrates, wherein, a gap between the openings adjacent to the spacer disposed between the openings is greater than that between the openings between which the spacer is not disposed.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
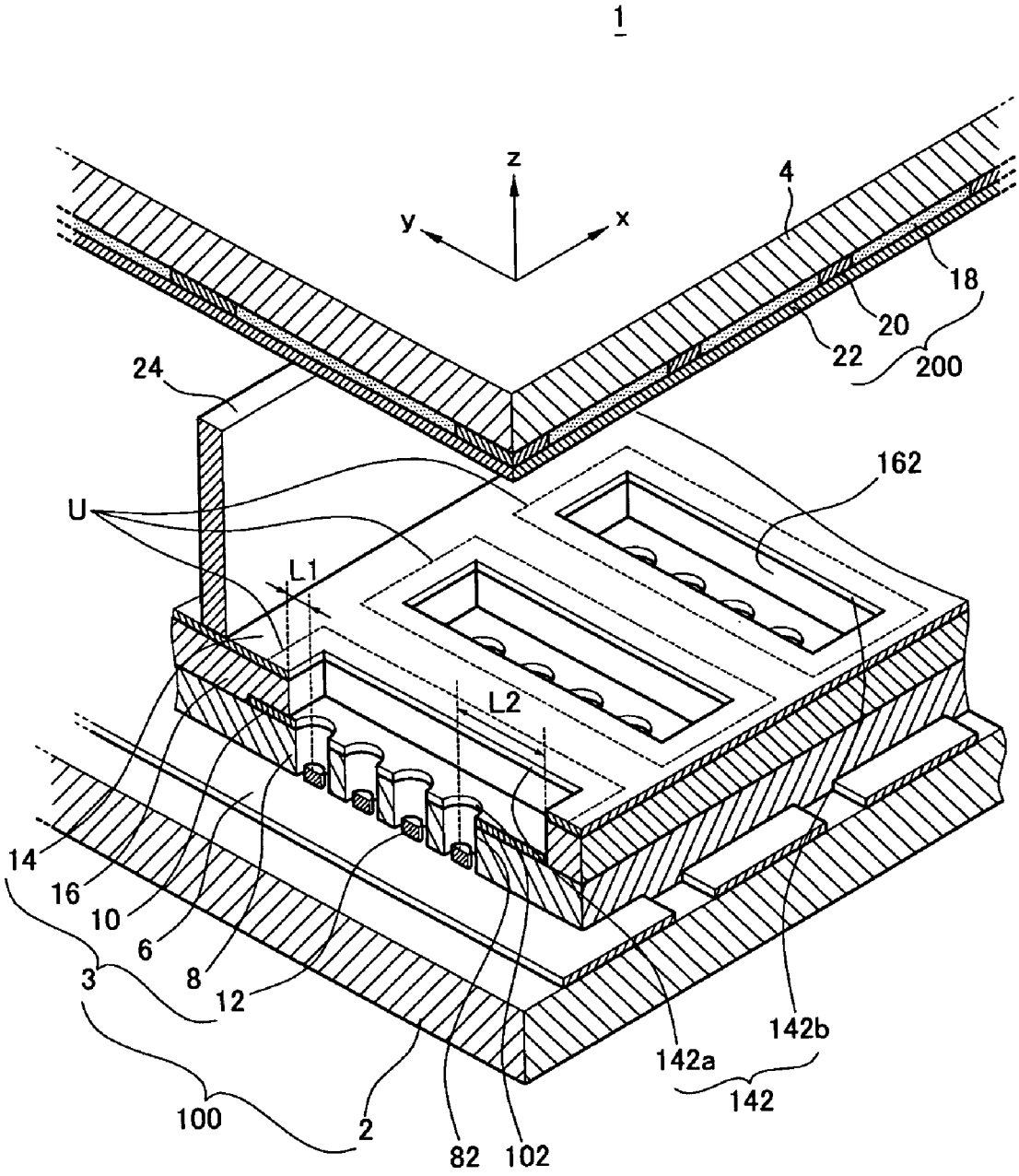
FIG. 1 is a partial exploded perspective view of an electron emission display according an embodiment of the present invention.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

Figure 2:
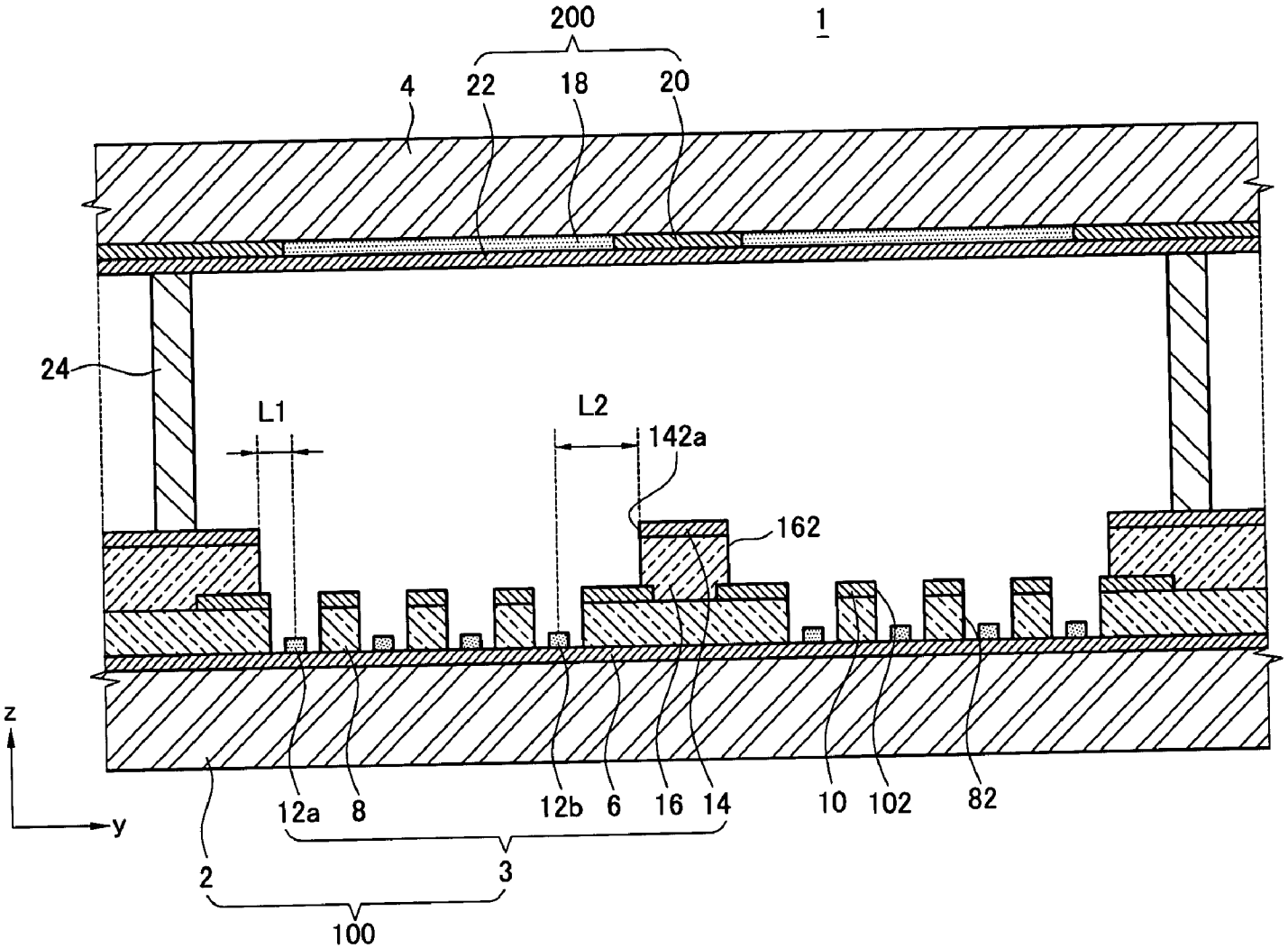
FIG. 2 is a partial sectional view of the electron emission display depicted in FIG. 1.
Figure 3:
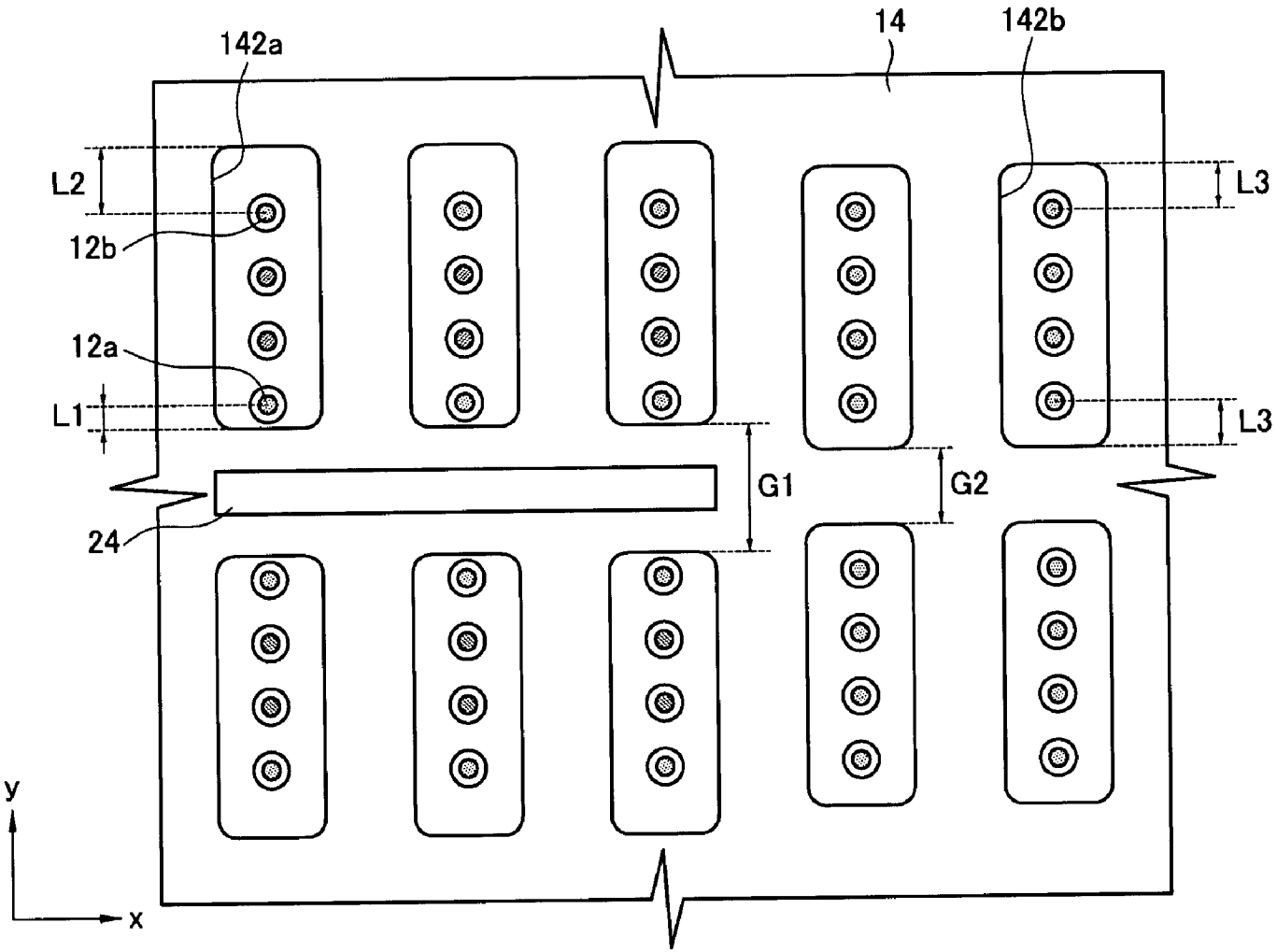
FIG. 3 is a partial top view of the electron emission display depicted in FIG. 1.

FIGS. 1 through 3 show an electron emission display according an embodiment of the present invention. Referring to FIGS. 1 and 2, an electron emission display 1 according to an embodiment of the present invention includes first and second substrates 2 and 4 facing each other at a predetermined interval. A sealing member (not shown) is provided at the peripheries of the first and second substrates 2 and 4 to seal them together. The space defined by the first and second substrates and the sealing member is evacuated to form a vacuum envelope kept to a degree of vacuum of about $10^{-6}$ torr.

A plurality of electron emission elements 3 is arrayed on the first substrate 2 to form an electron emission device 100. The electron emission display 1 is comprised of the electron emission device 100 and the second substrate 4 on which a light emission unit 200 is located.

The electron emission element 3 includes first and second insulation layers 8 and 16, a focusing electrode 14, and an electron emission region 12, all of which are placed at a crossed region (hereinafter, referred to as "a unit pixel region") where cathode and gate electrodes 6 and 10 cross each other. That is, a plurality of the cathode electrodes 6 is arranged on the first substrate 2 in a stripe pattern extending in a first direction (a direction of a y-axis in FIG. 1) and the first insulation layer 8 is formed on the first substrate 2 to cover the cathode electrodes 6. A plurality of the gate electrodes 10 is formed on the first insulation layer 8 in a stripe pattern extending in a second direction (a direction of an x-axis in FIG. 1) to cross the cathode electrodes 6 at right angles.

One or more electron emission regions 12 are formed on the cathode electrode 6 at the unit pixel region U. Openings 82 and 102 corresponding to the electron emission regions 12 are formed on the first insulation layer 8 and the gate electrodes 10 to expose the electron emission regions 12 on the first substrate 2.

The electron emission regions 12 may be formed of a material, which emits electrons when an electric field is applied thereto under a vacuum atmosphere, such as a carbonaceous material or a nanometer-sized material. For example, the electron emission regions 12 may be formed of carbon nanotubes, graphite, graphite nanofibers, diamonds, diamond-like carbon, C60, silicon nanowires, or a combination thereof. Alternatively, the electron emission regions 12 may be formed in a Mo-based or Si-based pointed-tip structure. The electron emission regions 12 may be formed in series along a length of one of the cathode and gate electrodes 6 and 10. Each of the electron emission regions 12 may have a flat, circular top surface. The arrangement and top surface shape of the electron emission regions are, however, not limited to the above case. For example, each of the electron emission regions 12 may be arranged in a square or circular pattern with a domed top surface shape or a pyramidal top surface shape, etc.

In the foregoing description, although a case where the gate electrodes 10 are placed above the cathode electrodes 6 with the first insulation layer 8 interposed therebetween is described, the present invention is not limited to this case. That is, the gate electrodes may be disposed under the cathode electrodes with the first insulation layer interposed therebetween. In this case, the electron emission regions may be formed on sidewalls of the cathode electrodes on the first insulation layer. In addition, the use of descriptors such as under and above are used merely to facilitate a description of the embodiments and not to restrict the invention thereto, that is by tipping, tilting or turning the embodiment on its side, or completely over does not change the aspects of the present invention.

In addition, the second insulation layer 16 is formed on the first insulation layer 8 while covering the gate electrodes 10 and the focusing electrode 14 is formed on the second insulation layer 16. That is, the gate electrodes 10 are insulated from the focusing electrode 14 by the second insulation layer 16. Openings 142 and 162 through which electron beams pass are formed through the second insulation layer 16 and the focusing electrode 14. The openings 142 formed through the focusing electrode 14 are classified into openings 142*a* that are adjacent to the spacers 24 and openings 142*b* that are not adjacent to the spacers 24.

The openings 142 of the focusing electrode 14 are formed by one per unit pixel region U to generally focus the electrons emitted from one unit pixel region U. Alternatively, the openings 142 of the focusing electrode 14 are formed by one per opening 102 of the gate electrode 10 to individually focus the electrons emitted from each electron emission region 12. The former is illustrated in this embodiment. In addition, the focusing electrode 14 may be formed on an entire surface of the second insulation layer 16 or may be formed in a predetermined pattern having a plurality of sections corresponding to the unit pixel regions U.

Describing the light emission unit, red (R), green (G) and blue (B) phosphor layers 18 are formed on a surface of the second substrate 4 facing the first substrate 2 and black layers 20 for enhancing the contrast of the screen are arranged between the respective R, G and B phosphors 18. The phosphor layers 18 may be formed corresponding to sub-pixels or formed in a stripe pattern.

An anode electrode 22 formed of a conductive material such as aluminum is formed on the phosphor and black layers 18 and 20. The anode electrode 22 functions to heighten the screen luminance by receiving a high voltage required for accelerating the electron beams and reflecting the visible rays radiated from the phosphor layers 18 toward the first substrate 2 back toward the second substrate 4.

Alternatively, the anode electrode 22 can be formed of a transparent conductive material, such as indium tin oxide (ITO), instead of the reflective conductive material. In this case, the anode electrode 22 is placed on the second substrate 4 and the phosphor and black layers 18 and 20 are formed on the anode electrode 22. Alternatively, the anode electrode 22 is formed of a transparent conductive material, and the electron emission display may further include a metal layer for enhancing the luminance.

Disposed between the first and second substrates 2 and 4 are spacers 24 for uniformly maintaining a gap between the first and second substrates 2 and 4. The spacers 24 are arranged corresponding to the black layers 20 so that the spacers 24 do not trespass on the phosphor layers 18.

In this embodiment, among the electron emission regions 12 disposed in the opening 142*a* adjacent to the spacers 24, an electron emission region 12*a*, which is closest to the adjacent spacer 24, is spaced apart from an inner wall of the opening 142*a* by a distance that is different from that from an electron emission region 12*b*, which is farthest from the adjacent spacer 24, to the inner wall of the opening 142*a*. For example, as shown in FIG. 2, in order to suppress the attraction of the electron beams due to the spacers 24 charged with the positive electric charges, the distance L1 from the electron emission region 12*a*, which is closest to the adjacent spacer 24, to the inner wall of the opening 142*a* is set to be less than the distance L2 from the electron emission region 12*b*, which is farthest from the adjacent spacer 24, to the inner wall of the opening 142*a* (L2>L1). That is, the electron emission region 12*a* closest to the adjacent spacer 24 is formed to be closer to the focusing electrode 14 so that the electron beams emitted from the electron emission region 12*a* can be repulsed away from the adjacent spacer 24 by the focusing electrode 14. The electron emission region 12*b* farthest from the adjacent spacer 24 is formed to be farther from the focusing electrode 14 so that the electron beams emitted from the electron emission region 12*b* can be diffused. Therefore, the electron beams emitted through the opening 142*a* adjacent to the spacer 24 maintain their directionalities even when the spacer 24 is charged with the positive electric charges.

The distances L1 and L2 may be properly set according to a degree of the change of the electron beam path caused by the spacer 24 charged with the positive electric charges. In addition, in order to set the distances L1 and L2 as described above, the openings 142*a* adjacent to the spacer 24 are shifted in a direction. That is, referring to FIG. 3, the openings 142*b* that are not adjacent to the spacer 24 are at one fixed distance relative to the other openings 142*b* that are not adjacent to the spacer while the openings 142*a* adjacent to the spacer 24 are at a second fixed distance away from the spacer 24 relative to the other openings 142*a* adjacent to the spacer 24. That is, a gap G1 between the openings 142*a* adjacent to the spacer 24 disposed between the openings 142*a* is set to be greater than a gap G2 between the openings 142*b* between which the spacer 24 is not disposed (G1>G2).

Accordingly, even when the electron emission regions 12 are arranged uniformly on the substrate 2 at identical distances regardless of the openings 142 in which the electron emission regions 12 are disposed, since the openings 142*a* adjacent to the spacer 24 are positioned at the second fixed distance, the distance between the electron emission regions 12 disposed in the openings 142*a* and the focusing electrode 14 can be set at an optimal position. A distance L3 between each electron emission region 12 disposed in the openings 142*b* that are not adjacent to the spacer 24 and each inner wall of the openings 142*b* is greater than L1 but less than L2 (L2>L3>L1).

Figure 4:
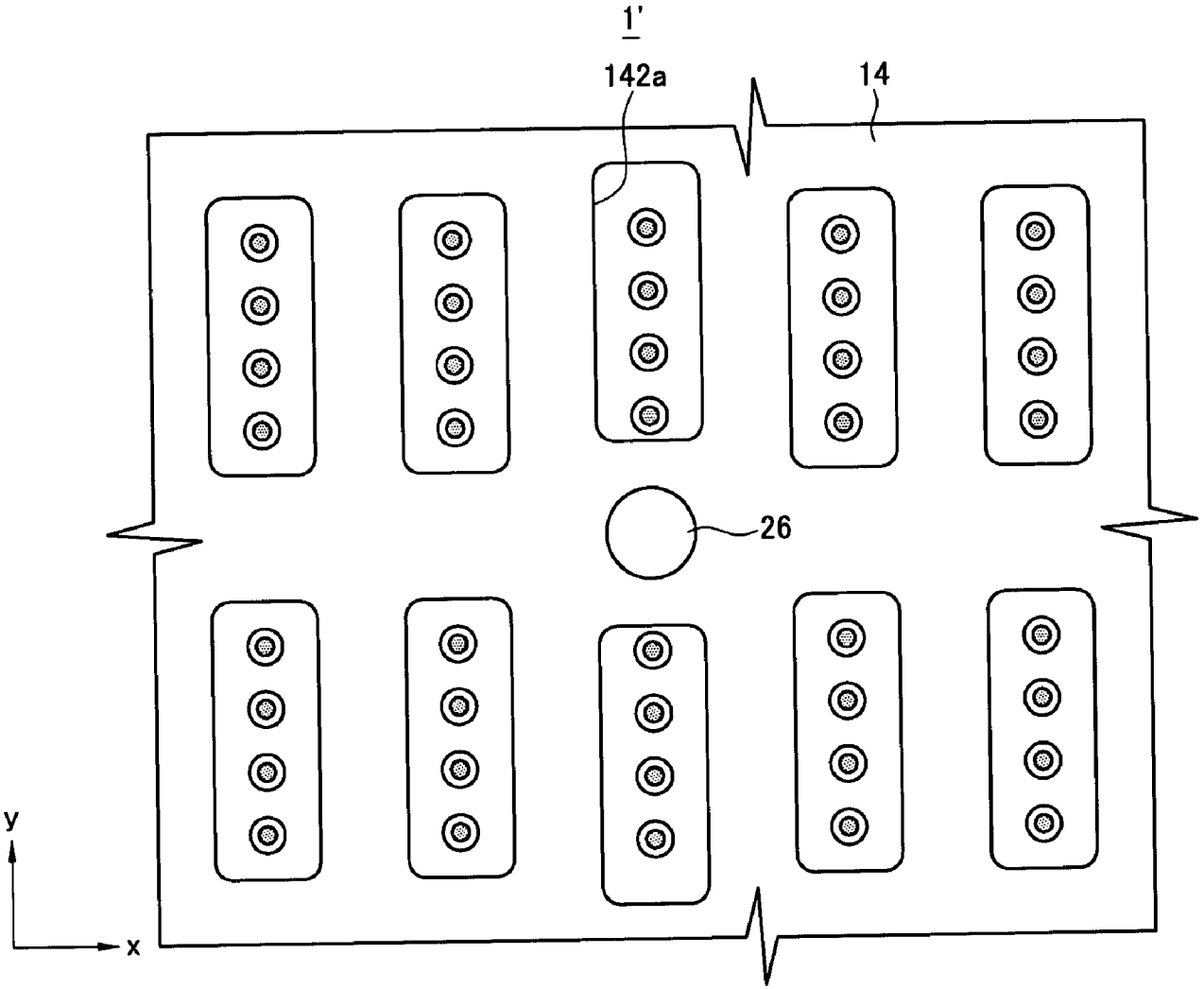
FIG. 4 is a partial top view of an electron emission display according to another embodiment of the present invention.

In this embodiment, although a case where the spacer 24 is formed in a wall-shape is illustrated, the present invention is not limited to this example. FIG. 4 shows an electron emission display according to another embodiment of the present invention. Referring to FIG. 4, spacers 26 of this embodiment are formed in a cylindrical shape having a circular, rectangular, or polygonal cross-section. The spacers 26 are disposed in regions defined between openings 142*a* of a focusing electrode 14. As in the foregoing embodiment of FIGS. 1 through 3, the openings 142*a* are located a certain distance away from the spacers 26.

Figure 5:
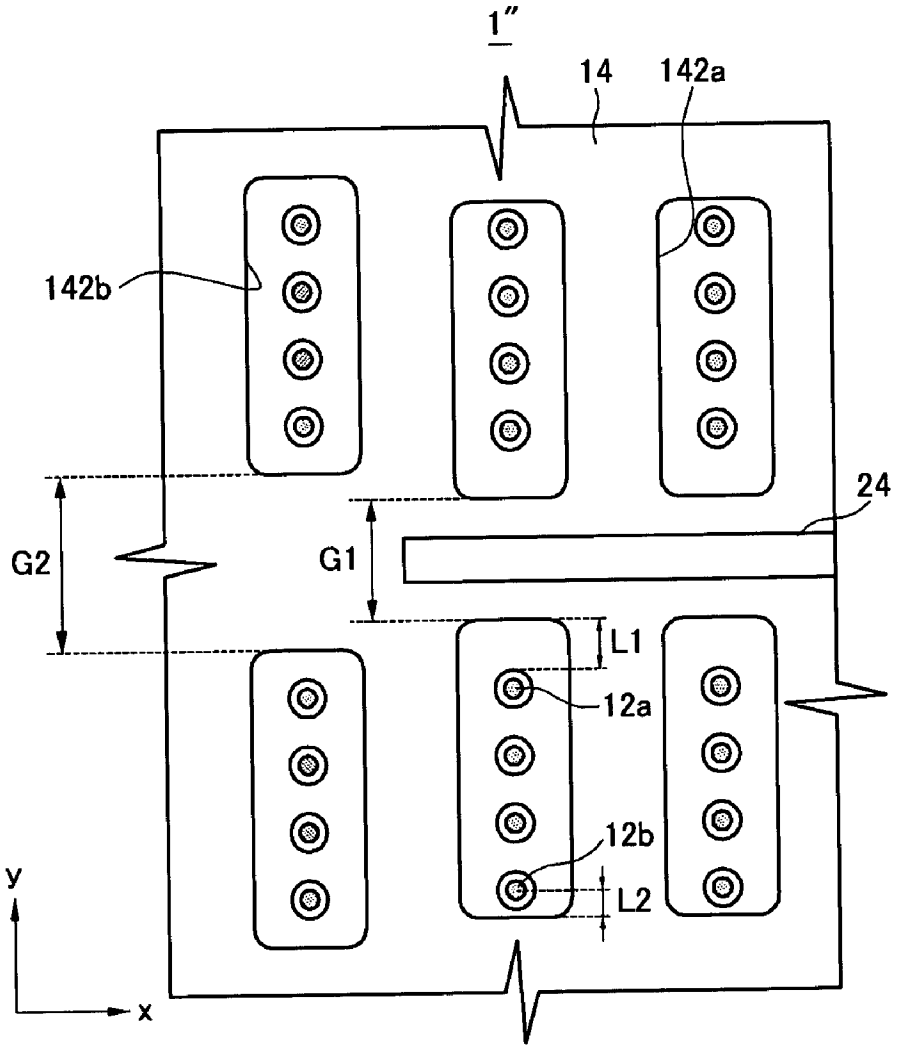
FIG. 5 is a partial top view of an electron emission display according to another embodiment of the present invention.

FIG. 5 shows an electron emission display according to another embodiment of the present invention. Referring to FIG. 5, spacers are designed considering a case where the spacers are charged with negative electric charges. That is, in an electron emission display 1" of this embodiment, openings 142*a* of the focusing electrode 14, which are adjacent to the spacers 24, are located at fixed positions that are closer together toward the spacers 24 than the openings 142*b*, to optimally set distances between electron emission regions 12 and inner walls of the openings 142*a*. Therefore, a gap G1 between the openings 142*a* adjacent to the spacer 24 disposed between the openings 142*a* is set to be less than a gap G2 between the openings 142*b* between which the spacer 24 is not disposed (G1<G2). As a result, a distance L2 between the electron emission region 12*b*, which is farthest from the spacer 24, in the opening 142*a* and the inner wall of the opening 142*a* is set to be less than a distance L1 between the electron emission region 12*a* closest to the spacer 24 and the inner wall of the opening 142*a* (L2<L1).

Although the electron emission display having the FEA elements is described in the above embodiments, the present invention is not limited to these examples. That is, the present invention may be applied to an electron emission display having other types of electron emission elements such as SCE elements, MIM elements and MIS elements.

According to aspects of the present invention, by adjusting distances between the electron emission regions and the focusing electrode, the change of the electron beam path, which is caused by the spacers charged with negative or positive electric charges, can be prevented. Therefore, the electron emission display according to aspects of the present invention can eliminate the detection of the spacers on the screen, which may be caused by the luminance difference around the spacers, thereby providing a high quality image.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. An electron emission display comprising:

first and second substrates facing each other;

a plurality of driving electrodes formed on the first substrate;

a plurality of electron emission regions controlled by the driving electrodes;

a focusing electrode disposed on and insulated from the driving electrodes and provided with openings through which electron beams pass;

a plurality of phosphor layers formed on a surface of the second substrate;

an anode electrode formed on surfaces of the phosphor layers; and a plurality of spacers maintaining a gap between the first and second substrates, wherein, among the electron emission regions disposed in the opening adjacent to the spacer, a first minimum distance between one electron emission region, which is closest to the adjacent spacer, and an inner wall of the opening is different from a second minimum distance between another electron emission region, which is farthest from the adjacent spacer, and the inner wall of the opening.

2. The electron emission display of claim 1, wherein the first minimum distance is less than the second minimum distance.

3. The electron emission display of claim 2, wherein distances between the electron emission regions are identical to each other.

4. The electron emission display of claim 3, wherein a gap between the openings adjacent to the spacer disposed between the openings is greater than that between the openings between which the spacer is not disposed.

5. The electron emission display of claim 2, wherein each of the spacers is formed in a wall-shape or a cylindrical shape.

6. The electron emission display of claim 1, wherein the first minimum distance is greater than the second minimum distance.

7. The electron emission display of claim 6, wherein distances between the electron emission regions are identical to each other.

8. The electron emission display of claim 7, wherein a gap between the openings adjacent to the spacer disposed between the openings is less than that between the openings between which the spacer is not disposed.

9. The electron emission display of claim 6, wherein each of the spacers is formed in a wall-shape or a cylindrical shape.

10. The electron emission display of claim 1, wherein the driving electrodes include cathode electrodes and gate electrodes crossing the cathode electrodes with an insulation layer interposed between the cathode and gate electrodes.

11. The electron emission display of claim 10, wherein the openings of the focusing electrodes are formed by one per each crossed region of the cathode and gate electrodes.

12. The electron emission display of claim 10, wherein the electron emission regions are formed of a material selected from the group consisting of carbon nanotubes, graphite, graphite nanofibers, diamonds, diamond-like carbon, $C_{60}$, silicon nanowires, and a combination thereof.

13. An electron emission display comprising:

first and second substrates facing each other;

cathode and gate electrodes formed on the first substrate and crossing each other with an insulation layer interposed between the cathode and gate electrodes;

a plurality of electron emission regions connected to the cathode electrode;

a focusing electrode disposed on and insulated from the cathode and gate electrodes and provided with openings through which electron beams pass;

a phosphor layer formed on the second substrate;

an anode electrode formed on the second substrate and electrically connected to the phosphor layer; and a spacer disposed between the first and second substrates, wherein, a gap between the openings adjacent to the spacer disposed between the openings is greater than that between the openings between which the spacer is not disposed.

14. An electron emission device comprising:

a first substrate;

driving electrodes on the first substrate;

electron emission regions on the first substrate, to be controlled by the driving electrodes to emit electron beams;

a focusing electrode disposed on and insulated from the driving electrode and provided with an opening through which the electron beams pass, wherein the electron emission regions are in the opening; and a structural member on the first substrate adjacent to the opening, wherein an inner edge of the opening closest to the structural member is spaced a first minimum distance from one of the electron emission regions closest thereto, to focus the associated electron beam with a first force, and an inner edge of the opening furthest from the structural member is spaced a second minimum distance from one of the electron emission regions closest thereto, to focus the associated electron beam with a second force different from the first force.

15. The electron emission device of claim 14, wherein the first minimum distance is less than the second minimum distance so that the first force repulses the electron beam away from the adjacent structural member and the second force forms the electron beam in a diffuse column.

16. The electron emission device of claim 14, wherein the first minimum distance is greater than the second minimum distance so that the first force forms the electron beam in a diffuse column and the second force repulses the electron beam toward the adjacent structural member.

17. The electron emission device of claim 14, wherein the driving electrodes include cathode electrodes and gate electrodes crossing the cathode electrodes with an insulation layer interposed between the cathode and gate electrodes.

18. The electron emission display of claim 14, wherein each electron emission region comprises one from the group of an FEA element, an SCE element, an MIM element, and an MIS element.

19. The electron emission device of claim 14, further comprising:

a second substrate facing the first substrate attached to the structural member;

a phosphor layer formed on the second substrate to emit visible light when excited by the electron beams; and an anode electrode formed on the second substrate and electrically connected to the phosphor layer to form an electron emission display.

20. The electron emission device of claim 19, wherein a space formed between the first and second substrates is filled with an excitation gas.

* * * * *